United States Patent [19]

Sobel

[11] 4,420,138

[45] Dec. 13, 1983

[54] SELF-LOCKING PICTURE FRAME CLIP

[76] Inventor: David D. Sobel, 15415 N. 22nd St., Phoenix, Ariz. 85022

[21] Appl. No.: 290,618

[22] Filed: Aug. 6, 1981

[51] Int. Cl.[3] ..... A47G 1/24

[52] U.S. Cl. ..... 248/496; 40/152.1; 248/295.1

[58] Field of Search ..... 248/495, 496, 477, 298, 248/295.1, 297.2; 40/152.1; 52/709, 710; 308/3 R; 312/224, 226; 403/104, 329

[56] References Cited

U.S. PATENT DOCUMENTS

| | | | |
|---|---|---|---|
| 2,651,489 | 9/1953 | Bell | 248/297.2 X |
| 2,767,609 | 10/1956 | Cousino | 52/709 X |
| 3,031,159 | 4/1962 | Waller | 248/496 X |
| 3,232,021 | 2/1966 | Wilson | 248/410 |
| 3,541,714 | 11/1970 | Bruck, Jr. | 40/156 |
| 3,924,307 | 12/1975 | Tate | 40/156 |
| 4,157,624 | 6/1979 | Sobel | 40/152.1 |
| 4,170,335 | 10/1979 | King | 248/297.2 X |
| 4,212,122 | 7/1980 | Reim | 40/152.1 |
| 4,216,597 | 8/1980 | Kocina et al. | 248/469 X |
| 4,315,393 | 2/1982 | Schack et al. | 411/427 X |

*Primary Examiner*—J. Franklin Foss
*Assistant Examiner*—David L. Talbott
*Attorney, Agent, or Firm*—Bauer & Amer

[57] ABSTRACT

A self-locking clip for a picture frame that is formed with a channel. The clip comprises an elongate piece of spring steel whose longitudinal end is bent to define a planar shelf from which depends a leg which defines an edge that is adapted frictionally to engage the inside surface of the channel and when the planar shelf is depressed, the edge is released from the inside surface of the channel to allow the clip to slide relative thereto.

10 Claims, 3 Drawing Figures

SELF-LOCKING PICTURE FRAME CLIP

This invention relates to a picture frame clip, and more particularly to a lip that is slidable with respect to a picture frame channel and that is self-locking in an adjusted position in the channel.

It has always been desirable to be able to hang a picture frame from a support such that the frame and its contents hang straight and vertical. To this end clips and other forms of hangers have been designed, either as a clip to be fastened to the frame to form a permanent part thereof as is taught in U.S. Pat. Nos. 3,031,159, 3,541,714, 3,924,307 and 4,216,597 to enable adjustment of the frame on a nail or other wall support. Other attempts are evidenced by fixed V-shaped projections formed as a permanent and integral part of the frame as taught in U.S. Pat. Nos. 4,157,624 and 4,212,122. However, with several of the numerous schemes heretofore, precise lateral movement of the frame relative to the wall is not possible because the V-shaped notches, when formed integrally with the frame elements, or when attached fixedly thereto, tend to limit movement into correspondingly discrete positions or "jumps," as it were.

The present invention overcomes several of the problems outlined above and provides for a clip that is adapted to move in and relative to a picture frame channel extrusion. The inventive unitary clip is preferably stamped from an elongate piece of flat, spring steel stock and includes a central planar body that provides a shelf defined by two substantially parallel opposed side edges. The longitudinal ends of the planar shelf are bent in substantially symmetrical manner and in opposite directions thus to form a pair of two downwardly depending angulated legs that define the shelf body.

The distal ends of each leg are sidened, along an abrupt discontinuity of cross-section, and are struck into a curved configuration giving rise to a bowed foot on each end of a respective leg. The abrupt discontinuity of cross-section between a given leg and foot, produces a sharp lateral wedging edge. The amount of bend of each curved or bowed foot, or its vertical height, so to speak, is precisely dimensioned and thus permits the curve of each foot to force-fittingly fit in the complementary sized channel of the picture frame extrusion. Owing to the fact that each leg is angulated with respect to the planar shelf body, when the foot is placed in the frame channel, the shelf projects outwardly from the channel and is locked or wedged into a given position by the biting action of the sharp lateral edge against facing regions of this channel.

When finger pressure on the planar shelf or body depresses the same, the legs are caused to flex along the longitudinal axis of the clip. This causes the bowed foot to rock or pivot, thus releasing the sharp lateral edge from engagement with facing portions of the channel extrusion. When this happens, the clip becomes free to slide on the curved feet, and under impetous provided provided by appropriately directed finger pressure on the planar shelf, can be adjustedly positioned anywhere along the channel. Release of depressing finger pressure on the planar body essentially reverses the above-described process and by means of the biting or frictional action of the sharp lateral edge against facing portions of the channel, the clip becomes locked with respect to the channel.

It is, therefore, an object of the present invention to provide a clip that can be used in a complementary sized channel of a picture frame extrusion.

It is a further object of the present invention to provide a clip that is slidable and adjustable within a complementary sized channel and that is adapted automatically to lock in the same.

It is another object of the present invention to provide a clip for hanging pictures that has infinite adjustment capability or resolution with respect to a picture frame channel.

It is a still further object of the present invention to provide a clip for hanging pictures that eliminates the need for nuts and bolts or swivel sets, does not use wires, and that is low in cost.

Other objects and features of the present invention will become apparent from the following detailed description considered in connection with the accompanying drawings. It is to be understood, however, that the drawings are designed for purposes of illustration only and not as a definition of the limits of the invention for which reference should be made to the appended claims. In the drawings, wherein the same reference numeral denotes the same elments throughout the several views:

Figure 1:
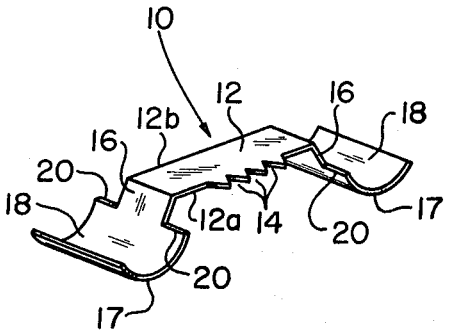
FIG. 1 is a perspective view of the inventive clip.
Figure 2:
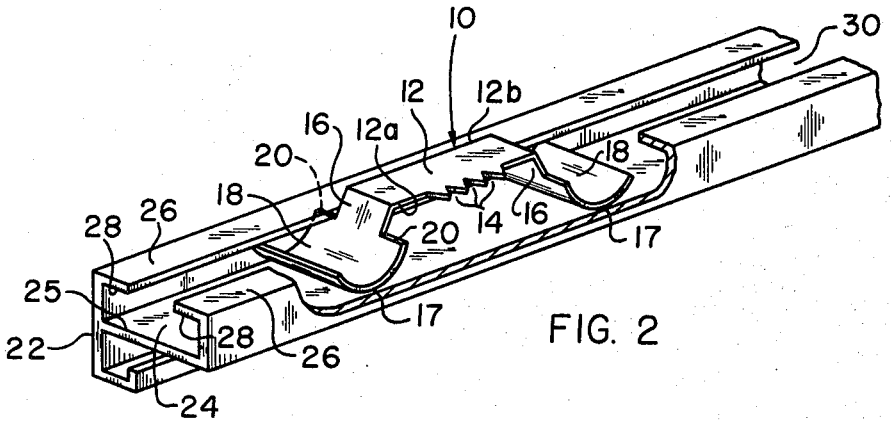
FIG. 2 is a perspective view of the clip of FIG. 1 shown placed in the complementary sized channel of a picture frame extrusion with parts of the latter broken away for clarity.
Figure 3:
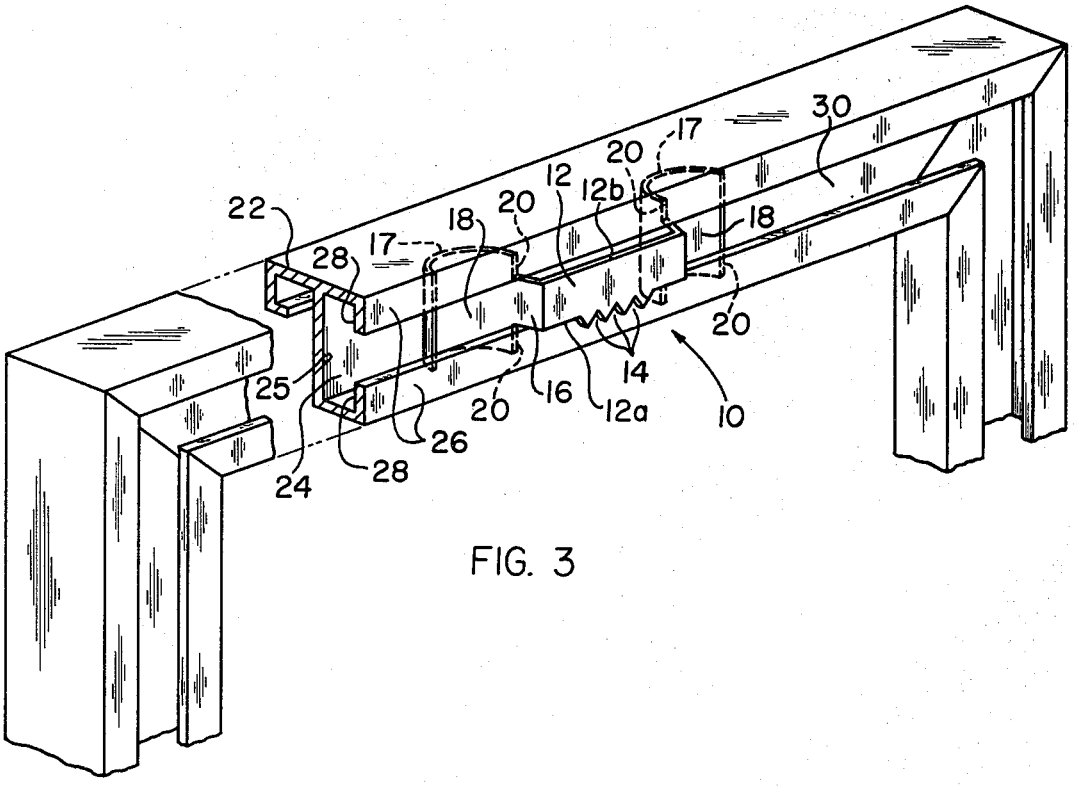
FIG. 3 is a perspective view similar to FIG. 2 although in FIG. 3 the inventive structure is seen from the back of the picture frame and as oriented for hanging on a wall.

In detail now and referring to the drawings, FIGS. 1 through 3 show the inventive clip and a complementary sized channel of a picture frame extrusion in which it is slidable and is carried. The clip is indicated generally by reference numeral 10 and includes an elongate or longitudinally extending planar body or shelf 12 defined by opposed, substantially parallel side edges 12*a* and 12*b*, as shown. A plurality of V-grooves or serrations 14 are formed on one of the side edges 12*a* of the planar body or shelf 12. The body or shelf 12 is symmetrically bent downwardly at its opposite longitudinal ends thus forming a pair of opposed, downwardly depending legs 16 that straddle the planar body shelf 12 and are at an acute angle disposed with respect thereto.

The distal longitudinal ends of each leg 16, in plan view, are widened abruptly with respect to the planar width of their respective leg 16 and body 12 and are curved at 17 giving rise to a bowed rocking surface on the bottom of foot 18 at the end of each leg. As can be seen in the drawings, each surface 17 of a respective foot 18 is oriented so as to extend in a direction along the longitudinal axis of planar shelf 12, and is disposed so as to be substantially coplanar therewith. Put another way, each foot 18 has its surface 17 aligned so as generally to be parallel to the planar surface presented by shelf 12. At the point or along the region where each leg 16 is widened to form its respective foot 18, there is a defined discontinuity of cross-section that produces a pair of relatively spaced sharp edges 20 on opposed transverse sides of the leg 16.

Clip 10 is designed to operate in a picture frame extrusion 22 formed with a C-shaped channel 24. As seen in FIGS. 2 and 3, channel 24 is defined by a base surface 25 and transversely spaced planar arms 26 that present inturned inner surfaces 28 opposed to and spaced from the base surface 25. The longitudinal space 30 is defined by the relative space between the arms 26.

The dimension or distance between the bottom of the bowed surface 17 of the foot 18 to the engaging edge 20 is substantially equal to the distance beween the surfaces 25 and 28 of the channel extrusion 24. This enables the foot 18 to be positioned between the extrusion surfaces such that the edge 20 normally is in wedging engagement with the respective inner surface 28 and is resiliently so maintained by the surface 17 resting against the base surface 25.

Each edge 20 is a transverse extend equal substantially to the transverse extent of its respective inner surface 28. The edges 20 of each of the opposite legs 16 are oppositely directed such that each wedges against the inner surface 28 to lock and prevent movement of the clip 10 relative to the channel 24 in the direction of their respective foot 18.

The transverse width of the leg 16 and body 12 is such as to enable the same to slide within the length of the longitudinal slot 30. However, because the feet 18 are wider than the slot 30, the clip 10 must be initially inserted into the same before the frame extrusions are assembled because thereafter the same cannot be removed therefrom through the slot 30.

When the clip 10 is positioned within the channel 24, the opposed edges 20 on opposite legs 16 normally wedge against their respective surfaces 28. This locks the clip 10 against relative sliding movement in either direction.

In use and operation, the clip 10 is placed into channel 24 with its body 12 projecting outwardly from the slot 30 as seen in FIGS. 2 and 3. When the clip 10 is thus placed in the channel, and owing to the resilient, spring-like nature of a respective foot 18, edge 20 normally is caused frictionally to engage the inside surfaces 28 of respective arms 26. The resilient action of each bowed foot 18 resting against the base surface 25 places its related edges 20 into wedging engagement to immobilize the clip 10 in channel 24. With the clip 10 so locked, the picture frame can be hung on a wall by merely placing an appropriately chosen V-groove 14 on a remotely placed wall support, as a nail (not shown) projecting from and driven into the wall.

To adjust and move clip 10 with respect to the slot 30 of the channel 24, the picture frame is removed from the wall and finger pressure is applied to the body shelf 12. The pressure is applied by slightly depressing the body shelf 12 in a direction towards the surface 25 of the channel 24. This causes the shelf to bow or flex slightly inwardly to minutely flex the legs 16 angularly outward while rocking the feet 18 about their curved surfaces 17. This correspondingly lowers the respective edges 20 out of their wedging engagement with their surfaces 28. When the edges 20 are released from their wedging engagement, the clip 10 is free to slide in the slot 30 of channel 24 under influence of appropriately inwardly directed finger pressure applied to the clip in a line-of-direction corresponding to the desired longitudinal direction the clip is to be moved. When the clip 10 is slid into the desired spot of the slot 30, finger pressure on shelf 12 is removed permitting the clip to resiliently return to its normal position whereby it once again becomes locked in the channel 24 by reason of the edges 20 moving into wedging engagement with the underside 28 of a corresponding channel-defining arm 26.

Preferably clip 10 is comprised of spring steel or some such resilient material. However, it is to be understood that the present invention is not to be limited to spring steel since other appropriately chosen materials having sufficient resiliency may be used. Thus, the clip can be made from a wide variety of non-metallic resilient materials such as plastic, nylon, fiberglas and the like.

While only one embodiment of the present invention has been shown and described, it is understood that many changes and modifications can be made hereto without departing from the spirit and scope hereof.

What is claimed is:

1. A clip adapted for use in a picture frame that has a channel with a base, the clip comprising an elongate planar shelf whose longitudinal ends are bent to form a pair of opposed angularly depending legs, the distal end of each leg, in plan view, widening along an abrupt discontinuity of cross-section into a foot that is sized to fit into the channel, said discontinuity of cross-section thereby defining an edge to frictionally engage facing, inside surfaces of the channel, the vertical height of each foot being dimensioned with respect to the height of the channel so that when said planar shelf is depressed, said edge of each foot is released from engagement with the facing, inside surfaces of the picture frame channel to allow the clip to slide relative thereto along the base.

2. The clip of claim 1, each said foot being bowed on its underside to displace its respective edge from a normally engaged relation with the channel when said planar shelf is depressed.

3. The clip of claim 2, said planar shelf including a plurality of serrations thereon.

4. The clip of claim 3, said serrations being placed along one of the longitudinally running side edges that define said planar shelf.

5. A clip movable for use in a C-shaped channel of a picture frame in which the C-shaped channel has a base and a slot defined between opposed inturned inner surfaces, said clip comprising a body the opposite ends of which have a leg angularly disposed relative thereto and being of a width to move in and along the length of the slot of the C-shaped channel, each of said legs being adapted for sliding engagement with the base surface of the picture frame channel and one of said legs terminating in a relatively wider foot that has a surface for rocking sliding engagement with the base surface of the C-shaped channel, an edge on said one of said legs for normal wedging engagement with an opposed inturned inner surface of the channel to prevent said clip from moving in the channel and being displaceable therefrom when said planar body is depressed to rock said foot surface to release the wedge of said edge to permit said clip to slide relative to the C-shaped channel.

6. A clip as in claim 5, and the other one of said legs terminating in said relatively wider foot having a surface for rocking sliding engagement with the base of the C-shaped channel and having an edge for normal wedging engagement with an opposed inturned inner surface of the channel to prevent said clip from moving in the channel in the direction of said respective leg.

7. A clip as in claim 6, and grooves on said body to support said clip from a support.

8. A clip for slidable adjustment in a C-shaped channel forming a part of a picture frame in which the channel has a base surface and a slot defined between opposed inturned inner surfaces spaced from the base surface, said clip being formed unitary of a single length of material including a resilient body having means along the side thereof for engagement with a support and having at its opposite ends an angularly disposed leg each leg terminating in a foot wider than the respective leg such that each leg slides in the slot of the C-shaped channel to enable said clip to be adjustably moved relative to the picture frame, and at least one said foot having an edge normally to be engaged between the base and with an opposed inturned inner surface to lock said clip from sliding movement relative to the picture frame and upon depression of said clip body said edge is disengaged from the inturned inner surface to enable said clip to be slid relative to the picture frame.

9. A clip as in claim 8, each said foot having an edge normally to be engaged with an opposed inturned inner surface, and each said foot having a bowed surface to be engaged slidingly with the base surface of the C-shaped channel normally to engage the edge of its respective foot with the opposed inturned surface of the C-shaped channel.

10. A clip as in claim 9, the edge on one of said feet being angularly opposed to the edge on the other of said feet to prevent movement of said clip in the direction of the edge that is engaged with the inturned inner surface.

* * * * *